United States Patent [19]

Collins, Jr. et al.

[11] Patent Number: 4,717,986

[45] Date of Patent: Jan. 5, 1988

[54] IGNITOR PROBE HAVING REPLACEABLE TIPS

[75] Inventors: Raymond L. Collins, Jr., 373 Atterbury Blvd., Hudson, Ohio 44236; Joseph J. Kucharski, Macedonia; Stephen A. Bryk, Akron, both of Ohio

[73] Assignee: Raymond L. Collins, Jr., Hudson, Ohio

[21] Appl. No.: 917,918

[22] Filed: Oct. 14, 1986

[51] Int. Cl.[4] ..... F23Q 3/00

[52] U.S. Cl. ..... 361/253; 123/169 EB; 313/122

[58] Field of Search ..... 361/253; 313/135, 136, 313/122; 123/169 R, 169 EL, 169 EB, 169 PH, 169 EC

[56] References Cited

U.S. PATENT DOCUMENTS

| | | | |
|---|---|---|---|
| 1,430,429 | 9/1922 | Bathurst . | |
| 2,301,572 | 11/1942 | Nowosielski | 123/169 |
| 2,626,595 | 1/1953 | Berstler | 123/169 |
| 3,505,568 | 4/1970 | Flynn | 317/79 |
| 4,249,103 | 2/1981 | Farrell | 313/135 |
| 4,309,738 | 1/1982 | Mulkins et al. | 361/253 |
| 4,470,799 | 9/1984 | Riggs | 431/266 |
| 4,553,927 | 11/1985 | Collins, Jr. | 431/264 |

*Primary Examiner*—L. T. Hix
*Assistant Examiner*—Brian W. Brown
*Attorney, Agent, or Firm*—Renner, Kenner, Greive, Bobak & Taylor

[57] ABSTRACT

An ignitor probe (10) for the ignition of burners and the like. The probe includes an elongate shaft (11) having an internal bore (14) passing therethrough and first and second ends (15,25), means for coupling (12) the probe to a power source, and an electrode assembly (13) carried within the internal bore and providing a centering couple (38), the centering couple communicating with one of the ends.

14 Claims, 4 Drawing Figures

IGNITOR PROBE HAVING REPLACEABLE TIPS

TECHNICAL FIELD

The present invention is directed toward electric probes of the type employed for igniting the burners of large steam generating units, viz., boilers. Such boilers are typically used on land for the generation of heat and/or power but can also be found on large ships. The burner is usually fired by oil which is atomized in the vicinity of the ignitor probe. A short succession of electric discharges from the probe tip causes combustion of the oil or gas which thereafter continues as the oil or gas is fed.

BACKGROUND ART

Typical of electric ignitor probe assemblies are the sparking or discharge type, which require high voltage and fire by charging a capacitor, and the glow plug type which employ high amperage to generate heat. As is known in the art, oil can bring the initial temperature of the boiler into operating ranges relatively quickly after which the boiler can be switched over to a different fuel such as coal.

Irrespective of the fuel, the ignitor must be able to withstand very high temperatures encountered initially by high energy employed for ignition and subsequently, by virtue of being positioned in the midst of the burner flame at least until the boiler operation temperature is reached and in some environments, indefinitely. Boilers of the type contemplated herein are very large dimensionally and hence, the ignitor probe assembly can be positioned ten feet or more into the burner.

Eventually, the ignitor probe will succumb to the high temperature environment and require replacement. A common cause of failure is burn-out of the electrode tip where the spark is generated. Inasmuch as existing ignitor probes are sealed structures in order to provide longer life, the entire probe is discarded. Prior to the present invention the old ignitor probe was removed and discarded, there being no attempt, much less ability, to repair it. Such practices are costly, particularly when a given facility may need to replace a dozen or more probes as frequently as every three months.

Although the problem has existed for a long time, the art has not taught an ignitor probe having a replaceable electrode. At least one early patent, U.S. Pat. No. 1,430,429 describes a spark plug for internal combustion engines that can be disassembled while mounted in the engine for a variety of reasons including priming the engine, releasing compression and replacement of the electrode.

U.S. Pat. No. 3,505,568 provides an ignition device for use in environments such as bakery ovens. One of the features of the device is the provision of a conductor rod in two sections joined by a conductive metal coupling. These elements allow for the replacement of a pitted electrode by disconnection of the rod sections at the coupling and substitution of a new electrode unit.

U.S. Pat. No. 4,309,738 discloses a recent ignitor plug which provides a metal sleeve to hold the electrode firmly within a ceramic insulator to prevent the electrode tip from vibrating during use. The electrode does not appear to be removable from the ignitor.

While the foregoing patents generally provide developments in spark plugs and ignitors, the art has not taught an ignitor probe for oil burning furnaces and like environments that can be removed and disassembled for the replacement of damaged components.

DISCLOSURE OF THE INVENTION

It is therefore an object of the present invention to provide an ignitor probe that can be disassembled following months of continuous exposure to burner environments.

It is another object of the present invention to provide an ignitor probe having a replaceable electrode tip.

These and other objects, together with the advantages thereof over known ignitor probes, which shall become apparent from the specification which follows, are accomplished by the invention as hereinafter described and claimed.

In general, the ignitor probe of the present invention comprises an elongated shaft having an internal bore passing therethrough and first and second ends, means for coupling the probe to a power source and an electrode assembly carried within the internal bore which provides a centering couple communicating with one of the ends.

An ignitor probe is also provided which comprises an elongate shaft having an internal bore passing therethrough, first and second end members, at least one of which is removable and an electrode assembly carried within the internal bore and separable from one of the end members.

Also provided in combination is an ignitor probe and wire subassembly. The subassembly includes wire means, first connecting means carried at one end of the wire means for attachment to a power source, second connecting means carried at the other end of the wire means and engageable with the electrode assembly of the ignitor probe, insulator means encompassing the second connecting means, and sleeving means received by the insulator means and covering a portion of the wire means.

PREFERRED MODE FOR CARRYING OUT THE INVENTION

Figure 1:
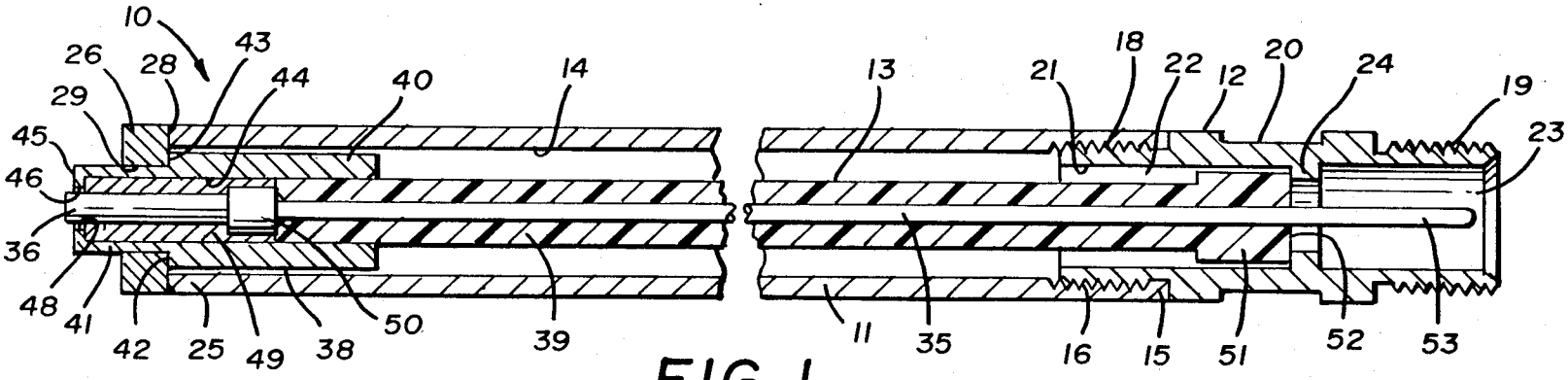
FIG. 1 is a side elevation, partially in section, of the ignitor probe of the present invention with a portion broken away to allow presentation of both ends in one view.

The ignitor probe of the present invention is depicted generally by the numeral 10 in FIG. 1. Each of the probes depicted in FIGS. 1–3 has a different diameter and hence, a somewhat varied configuration as will be discussed herein. With respect to the probe depicted in FIG. 1, it includes an elongate shaft 11, means for coupling 12 the probe to a power source, and an electrode assembly 13.

The shaft 12 is hollow having a bore 14 passing axially therethrough. Inasmuch as it will be subjected continuously to high temperatures in the burner environment, it is preferably a corrosion resistant alloy such as stainless steel. The means for coupling 12 is preferably of the same material.

The inboard end 15 of shaft 11 is provided with a coarse interior thread 16 for engagement with a mating interior thread 18 carried by the means for coupling or end member 12. The end member 12 has a comparable diameter to shaft 11 and is itself provided with an exterior threaded end 19 for connection with a pipe (not shown) that is normally employed to position the probe well into the burner. A pair of flats 20 can be milled into the end member 12 for positioning of a wrench to aid tightening and loosening of the shaft from the pipe. The end member 12 carries an internal bore 21 which provides first and second chambers 22 and 23, respectively, separated by an internal ring forming a shoulder 24.

Returning to the shaft 11, the outboard end thereof 25 receives an end cap 26 which is permanently affixed thereto by a weld 28. The end cap 26 carries an internal bore 29 smaller than the diameter of bore 14.

With reference now to the electrode assembly 13, it comprises a long electrode wire 35, an electrode tip 36, a centering collar 38 and an insulator sleeve 39. The centering collar 38 is a two-step cylindrical component comprising a conductive metal and preferably Inconel, a registered trademark of The International Nickel Co., Inc., for nickel, iron and chromium alloys. The rear body portion 40 is received freely within the bore 14 of shaft 11. The forward neck portion 41 fits closely within the bore 29 of end cap 26. A shoulder 42, separating the body and neck abuts against the inside face 43 of end cap 26.

The neck and body have a continuous bore 44 passing therethrough which is open at the body end and terminated by a rim 45 at the neck end. The rim carries a hole 46 which provides a circumferential edge 48. The electrode tip 36 is centered within the hole 36 and bore 44 and is separated therefrom by an insulating sealing material 49 capable of withstanding high heat such as aluminum oxide. The electrode tip 36 is provided with a base 50 which is an enlargement to allow the electrode wire 35 to be welded thereto.

During use, the electrode wire can be connected to the positive side of an electrical power source and the body becomes the negative. Electricity flowing to the electrode tip 36 is isolated from the other metal components to prevent shorting. At the very tip, arcing occurs to the circumferential edge 48 which provides the spark necessary to ignite the fuel.

The electrode wire 35 is itself a good conductor, capable of withstanding high heat such as Inconel. It is held within a removable sleeve 39 of ceramic or comparable high heat resistance material which supports the wire, maintaining it away from contact with any of the oppositely charged metal components so as to prevent shorting and failure of the electrode. At the rear of the sleeve 39, a base 51 is provided, the end wall 52 of which abuts against the internal ring 25.

As is evident from the drawings, the end of sleeve 39 and base 50 are carried within the first chamber 23 while the rearmost end 53 of wire 35 is carried within the second chamber 24. During assembly of the probe 10, the electrode assembly 13 just described is slid within the shaft 11 so that the neck of centering collar 38 protrudes through the end cap 26. Next, the means for coupling 12 is threaded onto the shaft 11 and tightened appropriately until the sleeve base 52 fully engages the internal ring 24.

The probe is now ready for use and need only be connected to power supply or intermediate device employed to extend the probe to a remote location well inside of the burner area such as the assembly taught in U.S. Pat. No. 4,553,927. As previously explained, the wire end 53 is connected to one side of a power source while the other is connected to the end member 12 which is electrically insulated from the wire.

After excessive arcing between the tip 36 and circumferential edge 46, the gap therebetween becomes too large for a spark to be generated and the probe fails. It is then a relatively simple matter to disassemble the probe, once removed from the burner, and replace the electrode assembly 13. If desired, the insulator sleeve 39 is capable of re-use thereby effecting a further cost savings.

The probe 10 depicted in FIG. 1 is one embodiment of the present invention where a fairly large diameter probe has been designed. Other burner assemblies employ smaller probes, having increasingly narrow diameters. These have been exemplified in FIGS. 2 and 3 which shall be described next.

Figure 2:
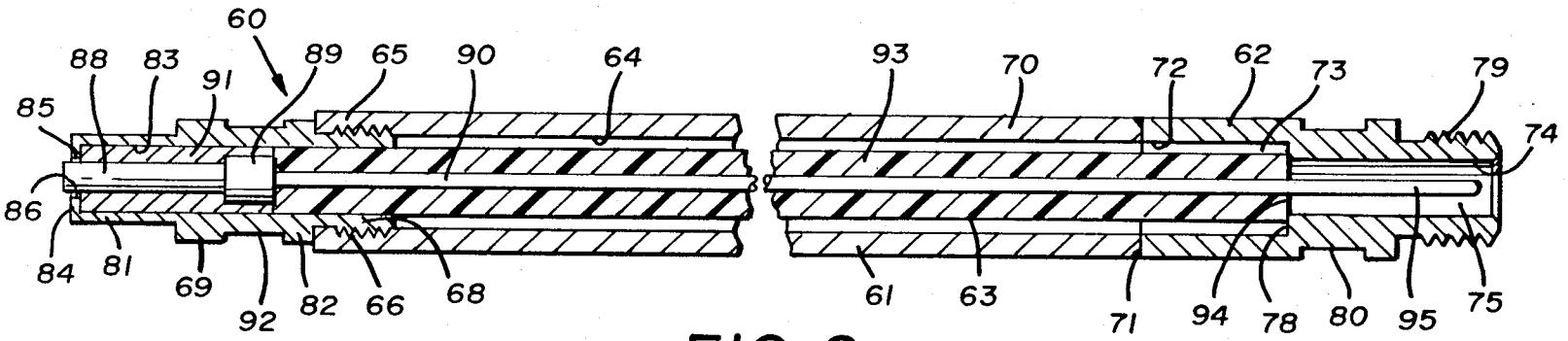
FIG. 2 is a side elevation, similar to FIG. 1, depicting an alternate embodiment.

With reference to FIG. 2, the probe 60 comprises a shaft 61, means for coupling 62 and the electrode assembly 63. The shaft 61 is hollow having a bore 64 passing axially therethrough. The outboard end 65 of shaft 61 is provided with a coarse internal thread 66 for mating engagement with an external thread 68 carried by centering collar 69.

At the opposite, inboard end 70 of shaft 61, the means for coupling 62 is permanently affixed as by a weld 71. While means for coupling 62 could be removable, the threading operations would add to the cost and therefore a permanent connection is preferred. Means for coupling 62 has a first internal bore 72 continuous with the bore 64, forming a first compartment 73 and a second bore 74 coaxial with 72 by narrower and providing a second compartment 75. A shoulder 78 separates the first and second compartments. A threaded exterior and 79 is provided for connecting the probe 60 is a power source or intermediate assembly (not shown) for positioning the probe into the burner environment. Milled flats 80 can be provided for gripping with a wrench.

The centering collar 69, an element of the electrode assembly 63, is removable from the probe 60 and closes the end 65 of shaft 61. The couple 69 includes a neck 81 and body 82 and axial bore 83 continuous with bore 64 and open at the body end. A rim 84 terminates the neck end and carries a hole 85, having a circumferential edge 86.

The electrode tip 88 extends through the hole 85 and arcs with the edge 86 in the manner described hereinabove. The tip 88 carries an enlarged base 89 to which the electrode wire 90 is welded. A refractory type material 91, aluminum oxide or other, is provided to center and position the electrode tip 88 within the centering collar 69. Finally, a pair of flats 92 can be provided for gripping by a wrench.

The electrode assembly 63 is completed with an insulating sleeve 93 of ceramic or other high temperature material, the end 94 of which abuts against the shoulder 78 in coupling member 62. The rearmost end 95 of the electrode wire is carried within the second compartment 75. Assembly, use and disassembly should be evident from the foregoing description and need not be detailed here.

Figure 3:
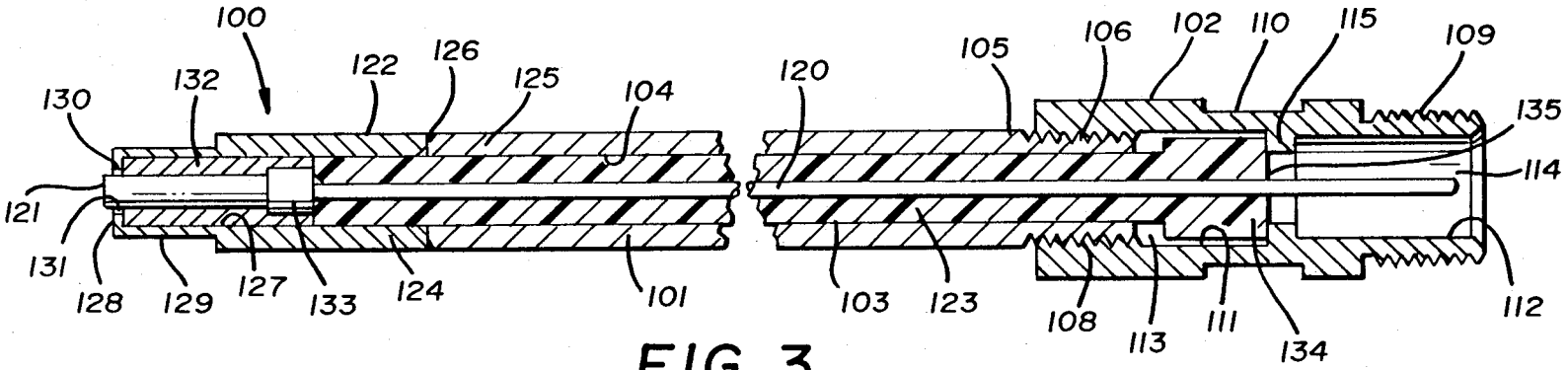
FIG. 3 is a side elevation, similar to FIG. 1, depicting another embodiment.

With respect now to FIG. 3, the third embodiment depicts a probe 100 which comprises a shaft 101, means for coupling 102 and the electrode assembly 103. The shaft is again hollow having a bore 104 passing axially therethrough. The inboard end 105 of shaft 101 is provided with a coarse external thread 106 for mating engagement with an internal thread 108 carried by means for coupling 102.

Except for the location of the threads, coupling 102 is similar to coupling 12 of the probe 10. It has a larger diameter than the shaft 101 and is itself provided with an exterior threaded end 109 for connection with a power source or pipe (not shown). A pair of flats 110 can be milled into the coupling 102 for a wrench as discussed herein. The coupling 102 carries internal bores 111 and 112 which provide a first chamber 113 and second chamber 114, respectively, separated by an internal ring forming a shoulder 115.

The electrode assembly 103 comprises an electrode wire 120, an electrode tip 121, a centering collar 122 and an insulator sleeve 123. The centering collar 122 is a two-step cylindrical component, similar to the collar 38 of probe 10, and comprises a conductive metal. The rear body portion 124 is affixed to the outboard end 125 of shaft 101 by a weld 126.

A bore 127, passing axially through the collar 122 and continuous with the bore 104 is open at the rear of body 124 and is terminated by a rim 128 at the end of neck 129. The rim 128 carries a hole 130 which provides a circumferential edge 131. The electrode tip 121 is centered within the hole 130 and bore 128 and is separated therefrom by an insulating sealing material 132. The electrode tip 121 is again provided with a base 133 to facilitate welding of the electrode wire thereto.

The electrode wire is again a good conductor and is held within the bore 104 by the removable sleeve 123. Because the shaft 101 is considerably smaller on probe 100, the sleeve 123 fits closely within the bore 104 with little air gap provided. At the rear of sleeve 123 a base 134 is provided, the end wall 135 of which abuts against the shoulder 115.

Because of the relatively small diameter of the probe shaft 101, there is not sufficient metal available to house a replaceable electrode assembly. As an aside, it should be noted that the electrode assemblies of each of the three probes are of approximately the same dimensions, which dimensions are necessary to provide the proper spark and also maximize life. Therefore, when the electrode eventually requires replacement, the electrode assembly and shaft of the probe 100 are discarded. Inasmuch as there is a fair amount of labor involved with the manufacture of the coupling 102, saving it still provides an economy over existing designs where the entire probe must be discarded.

As should now be apparent, the present invention provides a novel ignitor probe which, unlike existing probes, contains replaceable elements. Although the present probe can be disassembled, its design is such that it will not fail any sooner than a conventional probe occasioned by structural weaknesses, poor sealing or poor insulation. The design also provides an economy in manufacture over existing probes which are welded at both ends and then ground and polished to the exterior diameter of the shaft.

Figure 4:
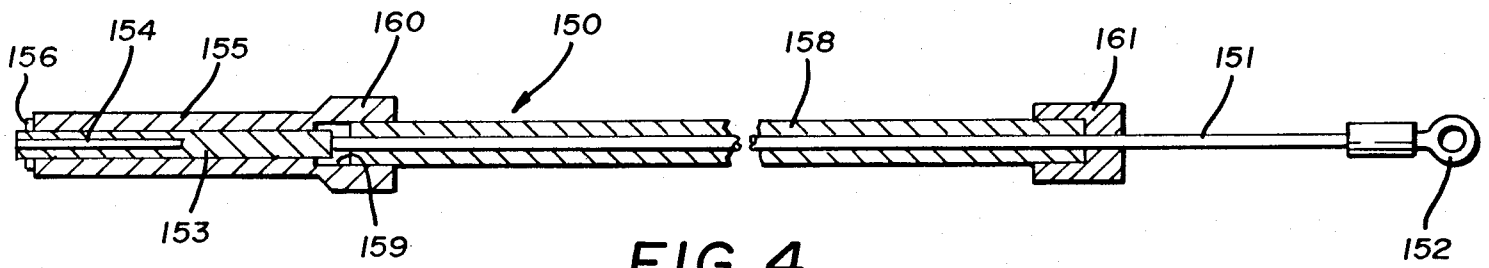
FIG. 4 is a side elevation, partially in section, of a wire subassembly for use with ignitor probes.

Each of the probes described herein provides an end of the electrode wire in the second compartment of the means for coupling. In FIG. 4, a wire sub-assembly for bringing power to the ignitor probe is presented. The sub-assembly, indicated generally by the numeral 150, includes a wire 151, preferably copper stranded, nickel coated, having a ring lug or similar connector 152 at one end and a female connector 153 at the opposite end.

The connector 153 is provided with a bore 154 which frictionally engages the electrode wire end 53 and the like from a probe 10. The connector is received in a ceramic insulator 155 which is described in detail in the aforementioned U.S. Pat. No. 4,553,927, the subject matter of which is incorporated by reference. A ring clip 156 retains the connector 153 within the insulator 155.

A woven ceramic sleeving 158 encases the wire 151 and is received within a recess 159 carried in the enlarged hub 160 of insulator 155. The sleeving 158 is preferably affixed within the recess with a high temperature cement. At the opposite end of sleeving 158, a ceramic cup 161 is affixed, also with the high temperature cement.

The wire sub-assembly 150 is normally encased in a pipe housing (not shown) but mentioned hereinabove as the means by which the ignitor probe can be positioned remotely under the burner. This arrangement is also discussed in the aforementioned U.S. Pat. No. 4,553,927. It is there explained that the pipe housing is often several times the length of the probe and provides an effective means of positioning the probe in less than crawl space areas. It is to be understood that the sub-assembly is not a part of the present invention but one which has utility therewith as well as with other ignitor probes of conventional design.

Based upon the foregoing disclosure, it should now be apparent that the design of the ignitor probe described herein will carry out the objects set forth hereinabove. It should also be apparent to those skilled in the art that the probe of the subject invention can readily be utilized in conjunction with various types of burners. It is to be understood that any variations evident fall within the scope of the claimed invention; therefore, the selection of specific materials and components elements can be determined without departing from the spirit of the invention herein disclosed and described. Moreover, the scope of the invention shall include all modifications and variations that may fall within the scope of the attached claims.

We claim:

1. An ignitor probe comprising:

an elongate shaft having an internal bore passing therethrough and first and second ends;

means for coupling said probe to a power source;

wherein said means for coupling provides at least a first internal chamber and a shoulder communicating with said electrode assembly, and is removably affixed to one of said shaft ends; and wherein said other of said ends is provided with a cap, said cap having a bore communicating with said internal bore of said elongate shaft; and an electrode assembly carried within said internal bore and providing a centering couple, said centering couple communicating with one of said ends;

wherein said centering couple comprises a body;

a neck smaller than said body, said body and neck having a continuous bore passing axially therethrough and said neck being partially closed by a rim having an opening to said continuous bore.

2. An ignitor probe, as set forth in claim 1, wherein said neck extends through said cap.

3. An ignitor probe, as set forth in claim 2, wherein said electrode assembly further includes wire means;

an electrode tip connected to one end of said wire means; and insulating sleeve means encompassing a majority of said wire means.

4. An ignitor probe, as set forth in claim 3, wherein said electrode tip is received in said opening of said rim without contact therewith or any direct contact with said centering couple and said insulating sleeve provides an end in abutting contact with said shoulder.

5. An ignitor probe, as set forth in claim 4, wherein said means for coupling provides a second chamber within which the end of said wire means terminates.

6. An ignitor probe comprising:

an elongate shaft having an internal bore passing therethrough and first and second ends;

means for coupling said probe to a power source;

wherein said means for coupling provides at least a first internal chamber and a shoulder communicating with said electrode assembly, and is permanently affixed to one of said shaft ends; and an electrode assembly carried within said internal bore and providing a centering couple, said centering couple communicating with one of said ends;

wherein said centering couple is removably affixed to the other of said shaft ends and comprises:

a body;

a neck smaller than said body, said body and neck having a continuous bore passing axially therethrough and said neck being partially closed by a rim having an opening to said continuous bore.

7. An ignitor probe, as set forth in claim 6, wherein said electrode assembly further includes wire means, an electrode tip connected to one end of said wire means; and insulating sleeve means encompassing a majority of said wire means.

8. An ignitor probe, as set forth in claim 7, wherein said electrode tip is received in said opening of said rim without contact therewith or any direct contact with said centering couple and said insulating sleeve provides an end in abutting contact with said shoulder.

9. An ignitor probe, as set forth in claim 8, wherein said means for coupling provides a second chamber within which the end of said wire means terminates.

10. An ignitor probe comprising:

an elongate shaft having an internal bore passing therethrough and first and second ends;

means for coupling said probe to a power source;

wherein said means for coupling provides at least a first internal chamber and a shoulder communicating with said electrode assembly, and is removably affixed to one of said shaft ends; and an electrode assembly carried within said internal bore and providing a centering couple, said centering couple communicating with one of said ends;

wherein said centering couple is permanently affixed to the other of said shaft ends, and comprises:

a body;

a neck smaller than said body, said body and neck having a continuous bore passing axially therethrough and said neck being partially closed by a rim having an opening to said continuous bore.

11. An ignitor probe, as set forth in claim 10, wherein said neck extends through said cap.

12. An ignitor probe, as set forth in claim 11, wherein said electrode assembly further includes wire means;

an electrode tip connected to one end of said wire means; and insulating sleeve means encompassing a majority of said wire means.

13. An ignitor probe, as set forth in claim 12, wherein said electrode tip is received in said opening of said rim withoout contact therewith or any direct contact with said centering couple and said insulating sleeve provides an end in abutting contact with said shoulder.

14. An ignitor probe, as set forth in claim 13, wherein said means for coupling provides a second chamber within which the end of said wire means terminates.

* * * * *